US010781575B2

(12) United States Patent
Lehmann et al.

(10) Patent No.: US 10,781,575 B2
(45) Date of Patent: Sep. 22, 2020

(54) ATTACHMENT CALIBRATION CONTROL SYSTEM

(71) Applicant: Deere & Company, Moline, IL (US)

(72) Inventors: Doug Lehmann, Durango, IA (US); David Myers, Dubuque, IA (US); Aaron Kenkel, East Dubuque, IL (US)

(73) Assignee: Deere & Company, Moline, IL (US)

( * ) Notice: Subject to any disclaimer, the term of this patent is extended or adjusted under 35 U.S.C. 154(b) by 169 days.

(21) Appl. No.: 16/176,165

(22) Filed: Oct. 31, 2018

(65) Prior Publication Data

US 2020/0131741 A1 Apr. 30, 2020

(51) Int. Cl.

| | |
|---|---|
| ***E02F 9/26*** | (2006.01) |
| ***E02F 3/43*** | (2006.01) |
| ***E02F 9/22*** | (2006.01) |
| ***E02F 3/28*** | (2006.01) |

(52) U.S. Cl.

CPC ..... *E02F 9/264* (2013.01); *E02F 3/431* (2013.01); *E02F 9/2203* (2013.01); *E02F 3/283* (2013.01)

(58) Field of Classification Search

CPC ..... E02F 9/264; E02F 3/431; E02F 9/2203; E02F 3/283

See application file for complete search history.

(56) References Cited

U.S. PATENT DOCUMENTS

| | | | |
|---|---|---|---|
| 5,748,097 | A | 5/1998 | Collins |
| 6,140,787 | A | 10/2000 | Lokhorst et al. |
| 6,418,364 | B1 | 7/2002 | Kalafut et al. |
| 6,547,012 | B2 | 4/2003 | Scarlett et al. |
| 7,979,181 | B2 | 7/2011 | Clark et al. |
| 8,145,394 | B2 | 3/2012 | Chiorean et al. |
| 8,654,608 | B2 | 2/2014 | Lindskov |
| 9,523,180 | B2 | 12/2016 | Deines |
| 9,540,794 | B2 | 1/2017 | Iwamura et al. |
| 9,580,883 | B2 | 2/2017 | Singh et al. |
| 9,714,497 | B2 | 7/2017 | Hague |
| 9,790,666 | B2 | 10/2017 | Kawamoto et al. |
| 2007/0277405 | A1 | 12/2007 | Anderson et al. |
| 2014/0110168 | A1* | 4/2014 | Pursimo ..... E21B 7/022 175/24 |
| 2017/0016211 | A1 | 1/2017 | Arimatsu et al. |
| 2017/0089041 | A1 | 3/2017 | Kawamoto et al. |

FOREIGN PATENT DOCUMENTS

| | | | |
|---|---|---|---|
| EP | 3214227 | A1 | 9/2017 |

* cited by examiner

*Primary Examiner* — Rodney A Butler

(57) ABSTRACT

An attachment calibration control system for a work machine where the system comprises a boom, an attachment, a boom actuator, an attachment actuator, a boom position sensor, an attachment position sensor, and a machine control module having a receiving unit, a calculation unit, and a calibration unit. The receiving unit is configured to receive a plurality of boom position signals and a plurality of attachment positions signal correlating to a plurality of sequential attachment position signals. The calculation unit is configured to calculate geometric parameters of the attachments based on the plurality of attachment position signal and the plurality of boom position signals correlating to the plurality of sequential attachment positions. The calibration unit is communicatively coupled to the boom actuator and the attachment actuator, and configured to adjust a default parameter of at least one of the boom position and the attachment position based on the geometric parameters of the attachment.

20 Claims, 10 Drawing Sheets

ATTACHMENT CALIBRATION CONTROL SYSTEM

CROSS-REFERENCE TO RELATED APPLICATIONS

N/A

FIELD OF THE DISCLOSURE

The present disclosure relates to a method and system for calibrating an attachment for a work machine.

BACKGROUND

Work machines, such as loaders, loader-backhoes, and excavators, may be outfitted by a myriad of attachments based on the desired function and use of the work machine. These attachments may be provided by either the original manufacturer of the work machine, or an aftermarket supplier. One of the problems with aftermarket attachments are varying geometric parameters (e.g. bucket depths for wheel loaders may range from two feet to four feet). The current absence of methods for coupling an aftermarket attachment to a control system of an original equipment manufacturer limits its function whereby the work machine is unable to adapt the attachment to automated features such as "return to level" mode and "truck clearance mode". Performing such functions are limited to manual control by the operator and the operator's expertise in controlling the work machine. Furthermore, precision control of the attachment is thereby affected because control system of the work machine fails to adequately recognize the attachment.

SUMMARY

In accordance with one embodiment, an attachment calibration control system for a work machine is disclosed. The calibration control system may include a boom having a first portion and second portion. The first portion is pivotally coupled to the frame about a boom pivot. An attachment may be pivotally coupled to the second portion of the boom. The attachment may have a tip. Moreover, a boom actuator may be coupled to the boom, wherein the boom actuator is configured to controllably move the boom about the boom pivot in response to a boom control signal. An attachment actuator may be coupled to the attachment, wherein the attachment actuator is configured to controllably move the attachment about the attachment pivot in response to an attachment control signal. Additionally, a boom position sensor may be coupled to the boom actuator, wherein the boom position sensor is configured to sense a boom position and send a boom position signal. An attachment position sensor may be coupled to the attachment actuator, where the attachment position sensor is configured to sense an attachment position and send an attachment position signal. The system may further comprise a machine control module having a receiving unit, a calculation unit, and a calibration unit. The receiving unit is configured to receive a plurality of boom position signals and a plurality of attachment position signals. The plurality of boom position signals and the plurality of attachment position signals correlate to a plurality of sequential attachment positions. The calculation unit is configured to calculate geometric parameters of the attachment based on these plurality of attachment position signals and the plurality of boom position signals. The calibration unit may be communicatively coupled to the boom actuator and the attachment actuator. The calibration unit is configured to adjust the parameter of at least one of the boom position and the attachment position based on the geometric parameters of the attachment.

In accordance with another embodiment, a method of calibrating an attachment pivotally coupled to a work machine is disclosed. The method may include coupling an attachment to the work machine such that the attachment is pivotally coupled about an attachment pivot to a second portion of the boom of the work machine. The method may further include positioning the attachment in a first position, and creating a first boom position signal using a boom position sensor and a first attachment position signal using an attachment position sensor based on the first position. Additionally, the method may include sending the first boom position signal and the first attachment position signal to a machine control module located on the frame of the work machine. The method may further include positioning the attachment in a second position, and creating a second boom position signal using the boom position sensor and a second attachment position signal using the attachment position sensor based on the second position. This may include sending the second boom position signal and the second attachment position signal to the machine control module. Additionally, the method may include calculating geometric parameters of the attachment based on the first and second boom position signals, and the first and second attachment position signals when the signals are received by the machine control module. As a result, the method may include calculating geometric parameters of the attachment based on the first and second boom position signals, and the first and second attachment position signals when the signals are received by the machine control module. Moreover, the method may include calibrating a default parameter of at least one of the boom position and the attachment position based on the geometric parameters of the attachment in the machine control module.

In accordance with yet another embodiment, a work machine including an attachment calibration control system is disclosed. The work machine may include a frame configured to house a power source and the frame is supported by ground engaging supports to support the frame on a geographic surface. An operator cab may be mounted on the frame and the operator cab may have an operator input device. The work machine may further include a boom having a first portion and a second portion, wherein the first portion is pivotally coupled to the frame about a boom pivot. Additionally, the work machine may include an attachment pivotally coupled to the second portion of the boom about an attachment pivot, wherein the attachment has a tip. The work machine may include a boom actuator coupled to the boom wherein the boom actuator is configured to controllably move the boom about the boom pivot in response to a boom control signal. Moreover, the work machine may include an attachment actuator coupled to the attachment wherein the attachment actuator is configured to controllably move the attachment about the attachment pivot in response to an attachment control signal. A boom position sensor may be coupled to the boom actuator wherein the boom position sensor is configured to sense a boom position and send a boom position signal. An attachment position sensor may be coupled to the attachment actuator wherein the attachment position sensor is configured to sense an attachment position and send an attachment position signal. Additionally, the work machine may include a machine control module. The machine control module may include a receiving unit, a calculation unit, and a calibration unit. The receiving unit may be configured to receive a plurality of boom position signals and a plurality of attachment position signals. The plurality of boom position signals and the plurality of attachment position signals may correlate to a plurality of sequential attachment positions. The plurality of sequential attachment positions may have the attachment tip pivot about a point where the attachment engages a geographic surface. The calculation unit may be configured to calculate geometric parameters of the attachment based on the plurality of attachment position signals and the plurality of boom position signals correlating to the plurality of sequential attachment positions. The calibration unit may be communicatively coupled to the boom actuator and the attachment actuator. The calibration unit may be configured to adjust a default parameter of at least one of the boom position and the attachment position based on the geometric parameters of the attachment.

These and other aspects and features of the present disclosure will be more readily understood upon reading the following detailed description in conjunction with the accompanying drawings.

BRIEF DESCRIPTION OF THE DRAWINGS

The detailed description of the drawings refers to the accompanying figures in which.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

Figure 1:
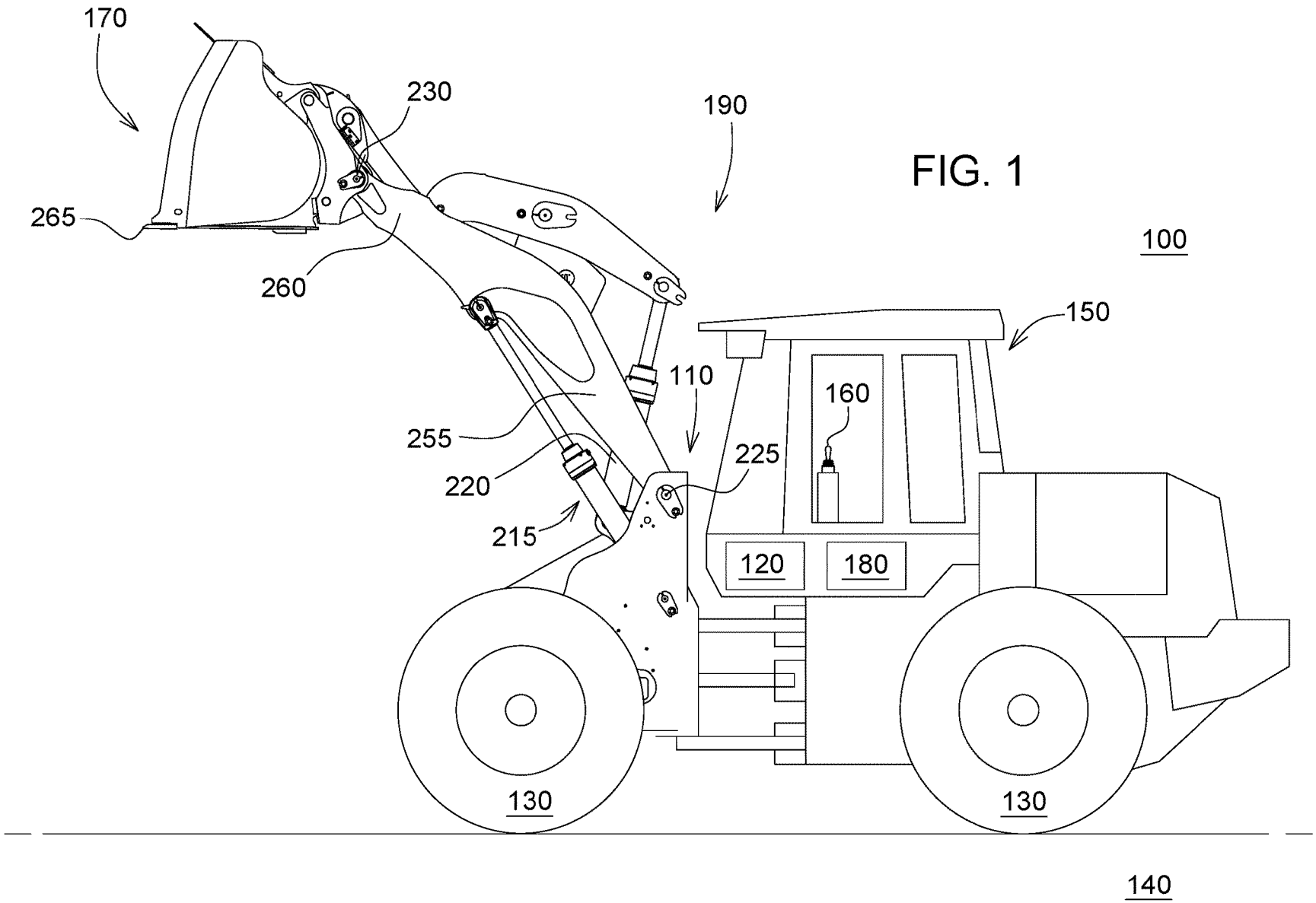
FIG. 1 is a perspective side view of a work machine in accordance with an embodiment of the present disclosure.
Figure 2:
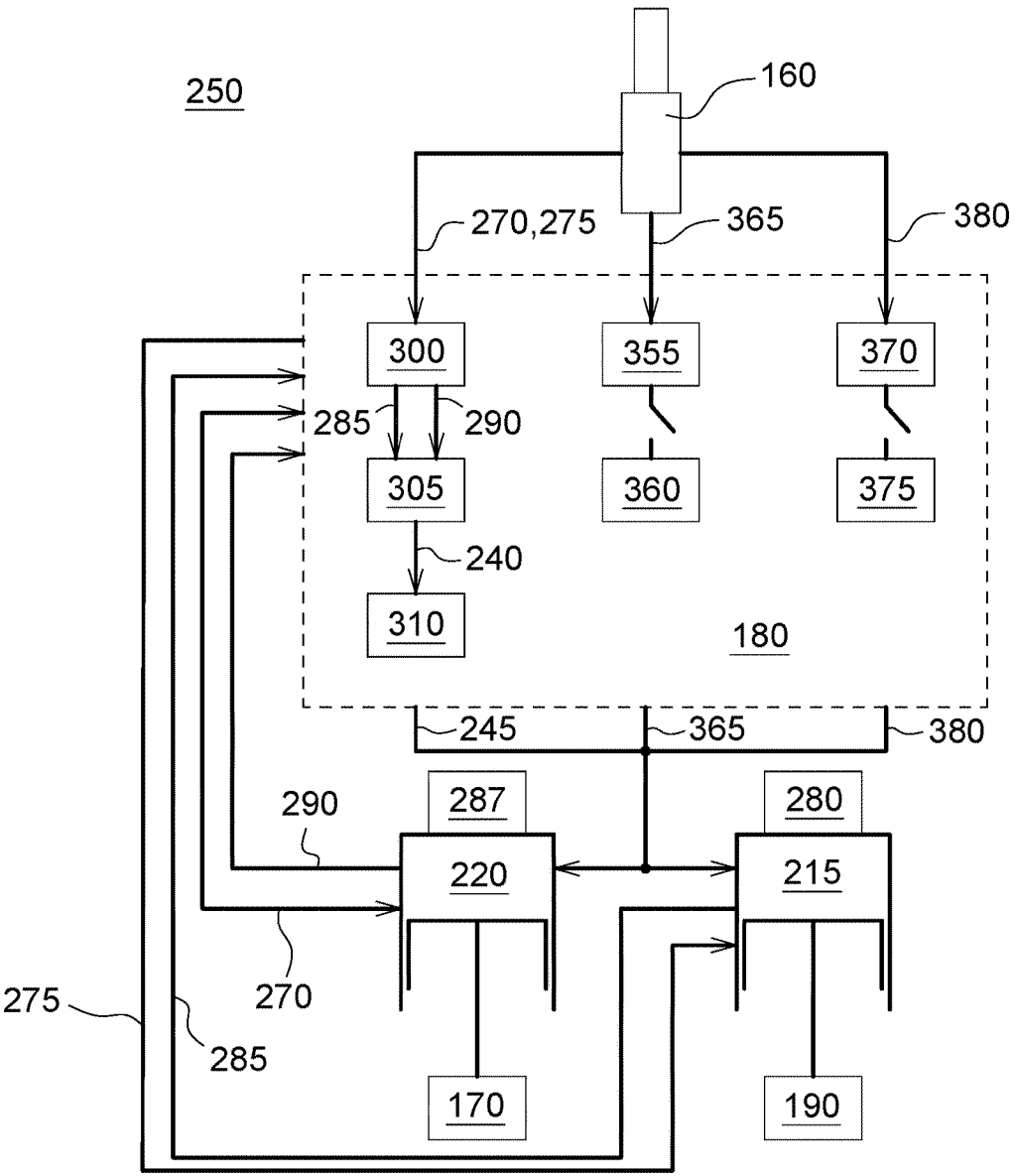
FIG. 2 is a schematic diagram of an attachment calibration control system for a work machine, in accordance with an embodiment of the present disclosure.

Referring now to the drawings and with specific reference to FIG. 1 and FIG. 2, a work machine 100 is shown, in accordance with certain embodiments of the present disclosure. As depicted in the FIGURES, the forward portion or direction of the work machine 100 is generally to the left and the rearward portion or direction of the work machine 100 is generally to the right. While one non-limiting example of the work machine 100 is illustrated as a loader, it will be understood that the work machine 100 may include other types of machines such as but not limited to a skid steer, front-end loader, a construction machine, a forestry machine, an agricultural machine, or an industrial mining machine. The work machine 100 may include a frame 110 configured to support a power source 120, ground engaging supports 130 to support the frame 110 on a geographic surface 140, and an operator station 150 mounted on the frame 110. In some embodiments, the power source 120 may be a power generating source such as but not limited to, a diesel combustion engine, a gasoline combustion engine, an electric motor, and any other known power generating source or combination thereof. The operator station 150 can house an operator and includes operator input devices 160 for controlling the components, including the attachment 170 of the work machine 100.

Moreover, the work machine 100 may include a machine control module 180 configured to monitor and execute various operational commands and other such functions of the work machine 100, such as the various hydraulic components of the work machine 100. The machine control module 180 may be communicatively coupled to one or more operator input device(s) 160. In some embodiments, the machine control module 180 may be communicably coupled to operator input devices 160 such as but not limited to, a steering input device (not shown), a throttle control (not shown), an attachment control (shown as an operator input device 160), and other such operational controls. Furthermore, the machine control module 180 may be communicably coupled to a display device (not shown) which displays or otherwise outputs instructions or other operational commands to the operator of the work machine 100. As a result, the machine control module 180 may receive and send input signals, output signals and other such data communicated between the various operational controls (not shown) of the work machine 100. The ground engaging supports 130 may be driven by the power source 120 to propel the work machine 100 in a direction of travel on a geographic surface 140. Moreover, the ground engaging supports 130 may be operably coupled to the steering input device (not shown), the throttle control (not shown), and other such operational controls configured to steer and maneuver the work machine 100. It should be appreciated that the machine control module 180 may correspond to an existing machine control module 180 of the work machine or the machine control module 180 may correspond to a separate processing device. For instance, in one embodiment, the machine control module may form all or part of a separate plug-in module that may be installed within the work machine to allow for the disclosed system and method to be implemented without requiring additional software to be uploaded onto existing control devices of the work machine 100.

Additionally, the work machine 100 may be coupled to at least one attachment 170 operably attached to the frame 110 or other portion of the work machine 100. For example, the attachment 170 may be detachable from the boom 190. Several attachments may be interchangeable on a single work machine 100.

In one non-limiting example, the attachment for a work machine 100 such as the loader shown, may include original equipment manufacturer parts such as multi-purpose buckets, rock buckets, side-discharge buckets, rollout buckets, pallet forks, snow pushers, and the like. Alternatively, the attachment for a work machine 100 may include but is not limited to aftermarket components such as ejector buckets, backfills blades, plows, car body forks, gravel scoops, and alternate manufacturers for above-mentioned attachments. Each attachment may be coupled to the frame 110 with a boom 190 comprising one or more attachment arms or linkages, and one or more actuators. The actuator can be a hydraulic or pneumatic actuator or cylinder, a linear actuator, or other types of actuators. The actuators can have extended and retracted conditions or positions. That is, the actuators can extend or lengthen and retract or shorten. The actuators can also have a plurality of intermediate positions between a fully extended position and a fully retracted position. A position sensor can detect or sense one or more of the position, direction, and speed of the actuator.

In the non-limiting example shown in FIG. 1, the work machine 100 comprises a boom actuator 215 and an attachment actuator 220 that may be configured to raise/lower and/or pivot the boom 190 and attachment 170 relative to the geographic surface 140 of the work machine 100. For example, the boom actuator 215 may be extended and retracted to pivot the boom 190 upwards and downwards relative to the boom pivot 225, thereby at least partially controlling the vertical positioning of the attachment 170 relative to the geographic surface 140. Similarly, the attachment actuator 220 may be extended and retracted to pivot the attachment 170 relative to the boom 190 about the attachment pivot 230, thereby controlling the tilt angle and orientation of the attachment 170 relative to the geographic surface 140. As will be described below, such control of the positioning and/or orientation of the various components of the work machine 100 may allow the boom 190 and the attachment 170 to be automatically moved to one or more pre-defined positions during operation of the work machine 100. For example, when the work machine 100 is being utilized to perform a material moving operation, such as moving material from a pile and dumping it back into the bin of a dump truck 385 (shown in FIG. 4A-4D), the boom 190 and attachment 170 may be automatically moved between a digging and loading position and a dumping or unloading position (shown in FIG. 4A-4D). Additionally, utilizing automated features such as "return to level" and "object clearance" mode improves the overall efficiency of the work machine 100 when performing the material moving operation. Moving the attachment 170 with such precision in manual mode and/or utilizing the automated features requires the machine control module 180 to recognize the geometric parameters 240 (exemplary embodiment of geometric parameters or present disclosure shown in FIG. 3A-3C) of the attachment 170. In other words, the attachment 170 must be calibrated for use by the work machine 100 such that the machine control module 180 adjusts the signal representing the default parameters 245 (shown in FIG. 2) of the work machine 100 to reflect the geometric parameters 240 of the attachment 170 and therefore optimize use of the attachment 170.

To address the aforementioned issues, referring now to FIG. 2 and FIG. 3A-3C, with continued reference to FIG. 1, a schematic of an attachment calibration control system 250 for the work machine 100 is illustrated. The attachment calibration control system 250 advantageously allows for the operator to calibrate the work machine 100 when coupling an attachment 170 from the operator station 150 with ease, wherein the default parameters 245 of the machine control module 180 are modified to reflect the geometric parameters 240 of the attachment 170. Furthermore, the attachment calibration control system 250 calibrates without the use of any extraneous components, and takes advantage of existing linkage kinematics.

The work machine 100 may comprise a boom 190 having a first portion 255 and a second portion 260 wherein the first portion 255 is pivotally coupled to the frame 110 of the work machine 100 about a boom pivot 225. The work machine 100 may further comprise an attachment 170 pivotally coupled to the second portion 260 of the boom 190 about an attachment pivot 230, wherein the attachment 170 has a tip 265, or also described as a front most edge. In this exemplary embodiment, the tip 265 may be the front edge of the attachment 170 (e.g. the cutting edge of the bucket). Identification of the tip's position relative to the frame 110 of the work machine 100 most accurately identifies the depth of the attachment, and thereby the "working volume" or "working depth" of the attachment, in the example of a loader with a bucket as an attachment. In other attachments, such as forks sized to move car bodies, the "working depth" may be the relevant calculation. Furthermore, knowledge of the position of the tip 265 relative to the frame 110 through linkage kinematics advantageously allows the operator to avoid inadvertent collisions when working with the attachments, thereby increasing operator safety and confidence.

An attachment actuator 220 may be coupled to the attachment 170 and communicably coupled to the machine control module 180, wherein the attachment actuator 220 is configured to controllably move the attachment 170 about the attachment pivot 230 in response to an attachment control signal 270 from the machine control module 180 located on the work machine 100. Commands for the attachment control signal 270 may originate from either an operator input device 160, or an automated program from the machine control module 180. Similarly, the boom actuator 215 may be coupled to the boom 190 and communicably coupled to the machine control module 180, wherein the boom actuator 215 is configured to controllably move the boom 190 about the boom pivot 225 in response to a boom control signal 275. Similar to the attachment control signal 270, commands for the boom control signal 275 may originate from either an operator input device 160, or an automated program from the machine control module 180.

During operation, the machine control module 180 may be configured to control the operation of each actuator (215, 220). In the non-limiting example shown, the actuators (215, 220) are valves in a hydraulic system wherein the machine control module 180 may be configured to control the flow of hydraulic fluid supplied to each of the cylinders. For instance, the machine control module 180 may be configured to send suitable control commands to the boom valves to regulate the flow of hydraulic fluid supplied to each cylinder, thereby controlling the stroke length of the piston rod associated with each cylinder. Any movement of the piston rod along its axis translates to a proportional movement of the relative linkage along the same axis, thereby considered synchronized. Similar commands may be transmitted from the machine control module 180 to the attachment valves to control a stroke length of the attachment cylinders. Additionally, the machine control module 180 may be configured to store information associated with pre-defined position settings for the boom 190 and/or attachment 170. For example, pre-defined loading and unloading positions may be stored within the machine control module's memory that correspond to pre-programmed factory settings and/or operator directed position settings.

A boom position sensor 280 may be coupled to the boom actuator 215 wherein the boom position sensor 280 is configured to sense a boom position and send a boom position signal 285 to the machine control module 180. The boom position sensor 280 may sense a net force, pressure in the associated hydraulic circuit, stroke length of the cylinder, flow volume or any other means capable of sensing the position of an actuator or a hydraulic cylinder. Similarly, an attachment position sensor 287 may be coupled to the attachment actuator 220 wherein the attachment position sensor 285 is configured to sense an attachment position and send an attachment position signal 290. Because the boom actuator 215 and the attachment actuator 220 can extend or lengthen, and retract or shorten, the actuators can have a plurality of intermediate positions between a fully extended position and a fully retracted position. The boom position sensor 280 and attachment position sensor 287 can detect or sense one or more of the position, direction, and speed of their respective actuators.

The machine control module 180, located on the work machine, may comprise a receiving unit 300, a calculation unit 305, and a calibration unit 310.

Figure 3A:
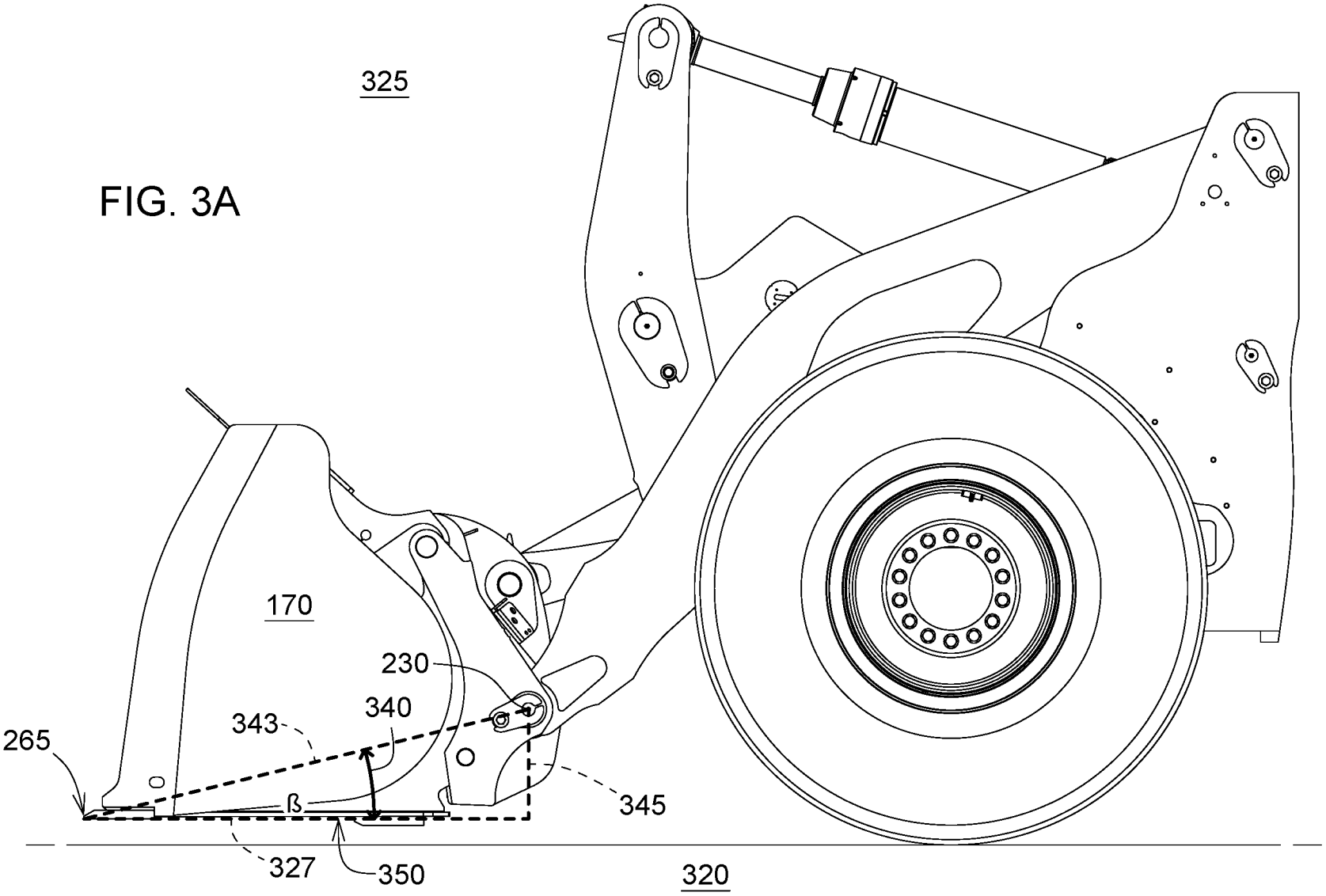
FIG. 3A is a first position of a plurality of sequential attachment positions, in accordance with an embodiment of the present disclosure.
Figure 3B:
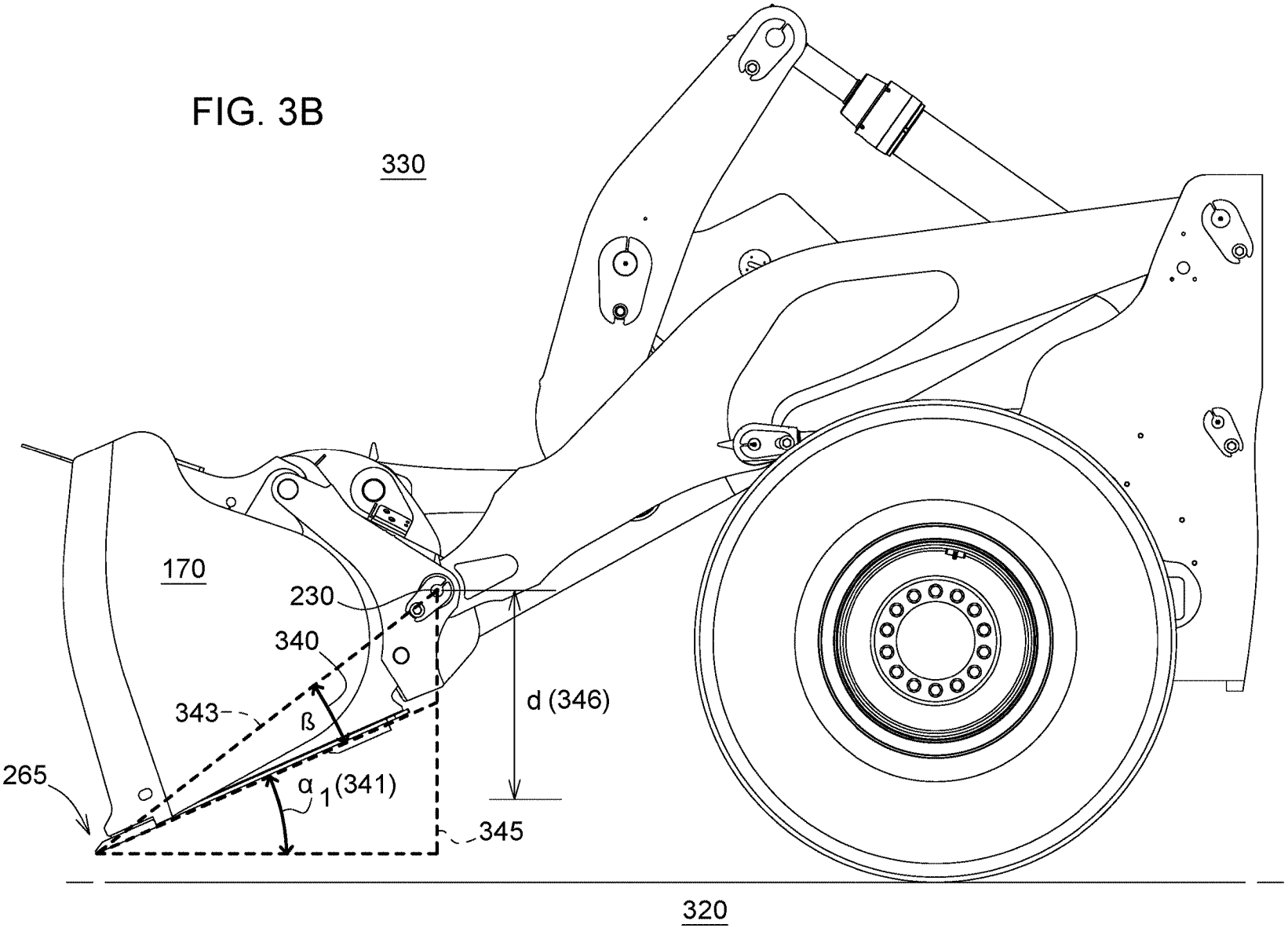
FIG. 3B is a second position of a plurality of sequential attachment positions, in accordance with an embodiment of the present disclosure.
Figure 3C:
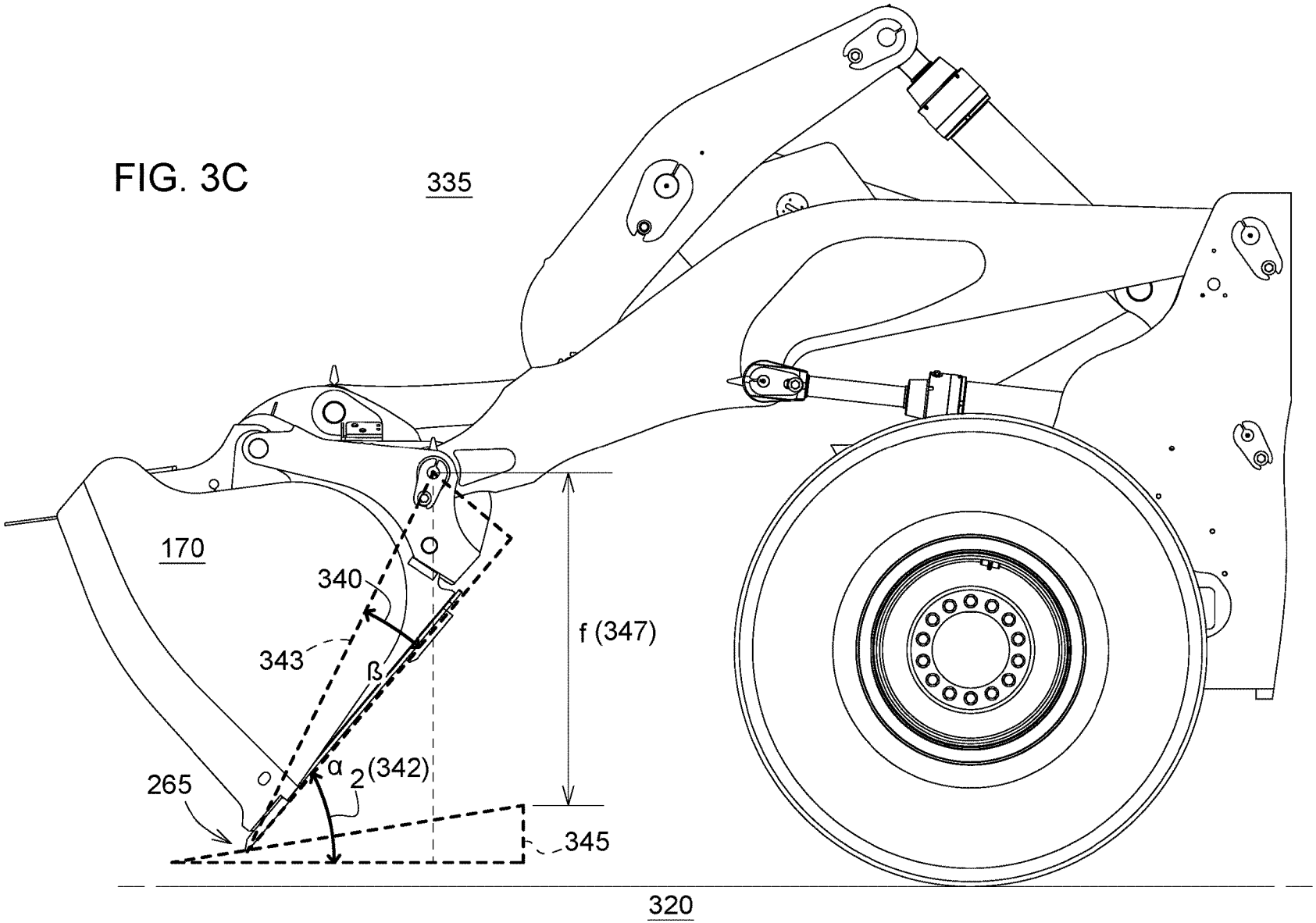
FIG. 3C is a third position of a plurality of sequential attachment positions, in accordance with an embodiment of the present disclosure.

The receiving unit 300 may be configured to receive a plurality of boom position signals 285 and a plurality of attachment position signals 290 based on the operator's input from an operator input device 160. The plurality of boom position signals 285 and the plurality of attachment position signals 290 may correlate to a plurality of sequential attachment positions 315. FIGS. 3A, 3B, and 3C demonstrate one embodiment of a plurality of sequential attachment positions. The plurality of sequential attachment positions 315 comprises the attachment pivoting about a point where the attachment tip 265 engages a level surface 320. The level surface 320 is either a geographic surface or a man-made surface. For example, the level surface 320 may comprise a substantially flat dirt surface, a paved road, a gravel bed, the flatbed of a truck, or a garage floor, to name a few.

In one exemplary embodiment, FIG. 3A demonstrates a first position 325 of the plurality of sequential attachment positions 315, wherein the first position 325 comprises a bottom surface 327 of the attachment 170 including the attachment tip 265 engaging the level surface 320. The operator may utilize an operator input device 160 to record the boom position signal 285 and the attachment position signal 290 in this first position 325. The operator may then move the attachment 170 to a subsequent position, for example as shown in FIG. 3B.

FIG. 3B demonstrates a second position 330 of the plurality of sequential attachment positions 315, wherein the second position 330 comprises the attachment 170 rotated a first arbitrary angle 341 ($\alpha$1) about a point where the attachment tip 265 engages the level surface 320. Again, the operator may utilize the operator input device 160 to record the boom position signal 285 and the attachment position signal 290 at the second position 330. Although obtaining position signals (285, 290) from two positions may be sufficient to calculate the geometric parameters 240 of the attachment 170, position signals may be acquired from another subsequent position, for example as shown in FIG. 3C, to improve the accuracy of the calculations.

FIG. 3C demonstrates a third position 335 of the plurality of sequential attachment positions 315, wherein the third position 335 comprises the attachment 170 rotated a second arbitrary angle 342 ($\alpha$2) about a point where the attachment tip 265 engages the level surface 320.

Now returning to FIG. 2, the receiving unit 300 on the machine control module 180 receives the plurality of sequential attachment position signals 315 from positions 325 (FIG. 3A), 330 (FIG. 3B), and possibly 335 (FIG. 3C). The calculation unit 305 on the machine control module 180 may be configured to calculate geometric parameters 240 of the attachment 170 based on the plurality of attachment position signals 290 and the plurality of boom position signals 285 correlating to the plurality of sequential attachment positions 315. The geometric parameters 240 may comprise of an angular position data 340 (also shown as $\beta$) of the attachment pivot 230 relative to the attachment tip 265 and the bottom surface 327, a vertical position data 345 of the attachment pivot 230 relative to the bottom surface 327, a horizontal position data 350 of the attachment pivot 230 relative to the attachment tip 265, and a linear distance of the attachment pivot relative to the attachment tip 343. These geometric parameters 240 are sufficient to determine a depth of the attachment 170, or an approximate "working volume" or "working depth". The geometric parameter 240 most relevant to "working depth" is the horizontal position data 350.

It is possible to calculate geometrically and trigonometrically the position of the attachment tip 265 relative to the frame 110 of the work machine 100 when the angular relationship between the elements (e.g. the linkage geometry of the boom 190) are known. FIGS. 3A-3C demonstrate a non-limiting example of sequential attachment positions.

In FIG. 3A, where the bottom surface 327 of the attachment 170 is lying on the level surface 320 (which may be a geographic surface 140), the following relationship may be used to determine the geometric parameters 240 along with the linkage geometry of the boom 190.

$$\sin \beta(340)=345/343$$

In FIG. 3B, where the attachment 170 is rotated a first arbitrary angle 341 ($\alpha$1) about a point where the attachment tip 265 engages the level surface 320, the following relationship may be used to determine the geometric parameters 240 along with the linkage geometry of the boom 190.

$$\sin(\alpha 1+\beta)=(345+346)/343$$

In FIG. 3C, where the attachment 170 is rotated a second arbitrary angle 342 ($\alpha$1) about a point where the attachment tip 265 engages the level surface 320, the following relationship may be used to determine the geometric parameters 240 along with the linkage geometry of the boom 190.

$$\sin(\alpha 1+\beta)=(345+346)/343$$

The calibration unit 310 may be communicatively coupled to the boom actuator 215 and the attachment actuator 220. The calibration unit 310 may be configured to adjust a default parameter 245 of either the boom position or the attachment position based on the geometric parameters 240 of the attachment 170. For example, the relative positions of the boom actuator 215 and the attachment actuator 220 for a "level position" as shown in FIG. 4B will vary based on the geometric parameters 240 of the attachment 170.

The machine control module 180 may further comprise a float unit 355. The float unit 355 may be communicatively coupled to the boom actuator 215 and the attachment actuator 220. The float unit 355 is configured to activate and de-activate a float mode 360 based on a float signal 365 from the operator input device 265 (i.e. the operator may press a switch or move a joystick, or any other suitable method). In one embodiment, the boom actuator 215 and the attachment actuator 220 depressurize in float mode 360 such that it places a net zero downward pressure on the attachment 170 contacting a level surface 320. In the exemplary embodiment of the present disclosure, float mode 360 is activated only for the first position 325 in the plurality of sequential attachment positions, as shown in FIG. 3A. The float mode 360 allows the attachment to "float" on the geographic surface 140 as the work machine 100 may be stationary, without receiving any additional downward pressure other than the weight of the boom 190. Next, the float unit 355 calculates the net force or pressure acting on the boom actuator 215 and attachment actuator 220. Alternatively, the float unit 355 may calculate the stroke length of the actuators (215, 220). In another embodiment, the float unit 355 may measure the flow volume through a valve and the hydraulic circuit for the boom actuator 215 and the attachment actuator 220. In other words, the float unit 355 may record the positions of the actuators (215, 220) and possibly the relative linkages of the boom 190. The calibration unit 310 subsequently recognizes the boom actuator 215 and the attachment actuator 220 as reference point zero when the attachment 170 is in this first position 325 shown in FIG. 3A, wherein zero is defined as the attachment 170 resting on a level surface 320. Upon identifying the reference point zero, the operator de-activates the float mode 360, thereby re-engaging the actuators (215, 220) in normal mode and positions the boom 190 and attachment 170 in a next plurality of sequential attachment positions 315 (e.g. the second position 330 and the third position 335). The float mode 360 advantageously simplifies the calculations required by the machine control module 180 in addition to creating an easily identifiable reference point zero for the operator. Alternatively, the calibration unit may recognize reference point zero during or after the operator de-actives the float mode.

Figure 4A:
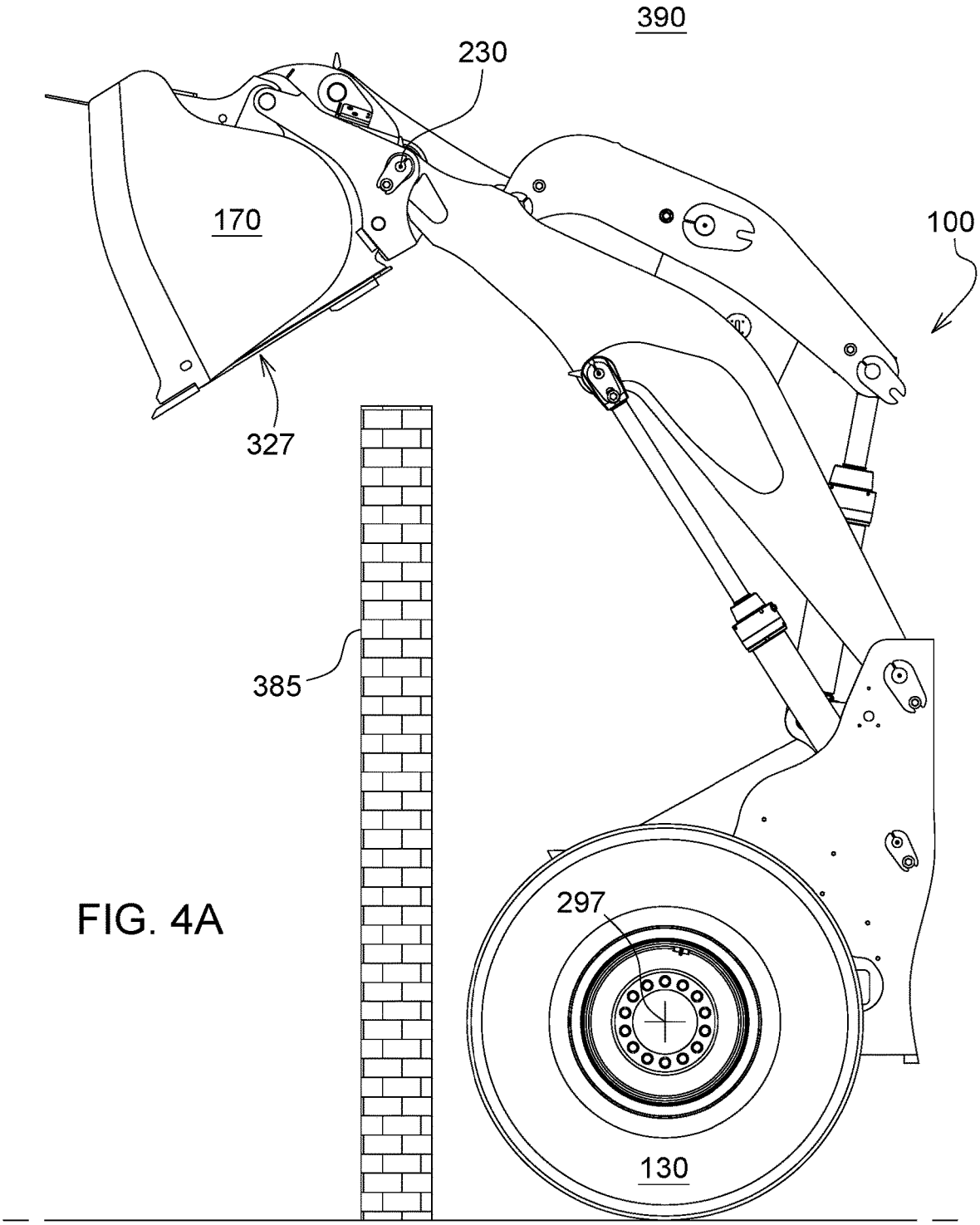
FIG. 4A illustrates an example view of a work machine performing a dumping operation in accordance with aspects of the present disclosure.
Figure 4B:
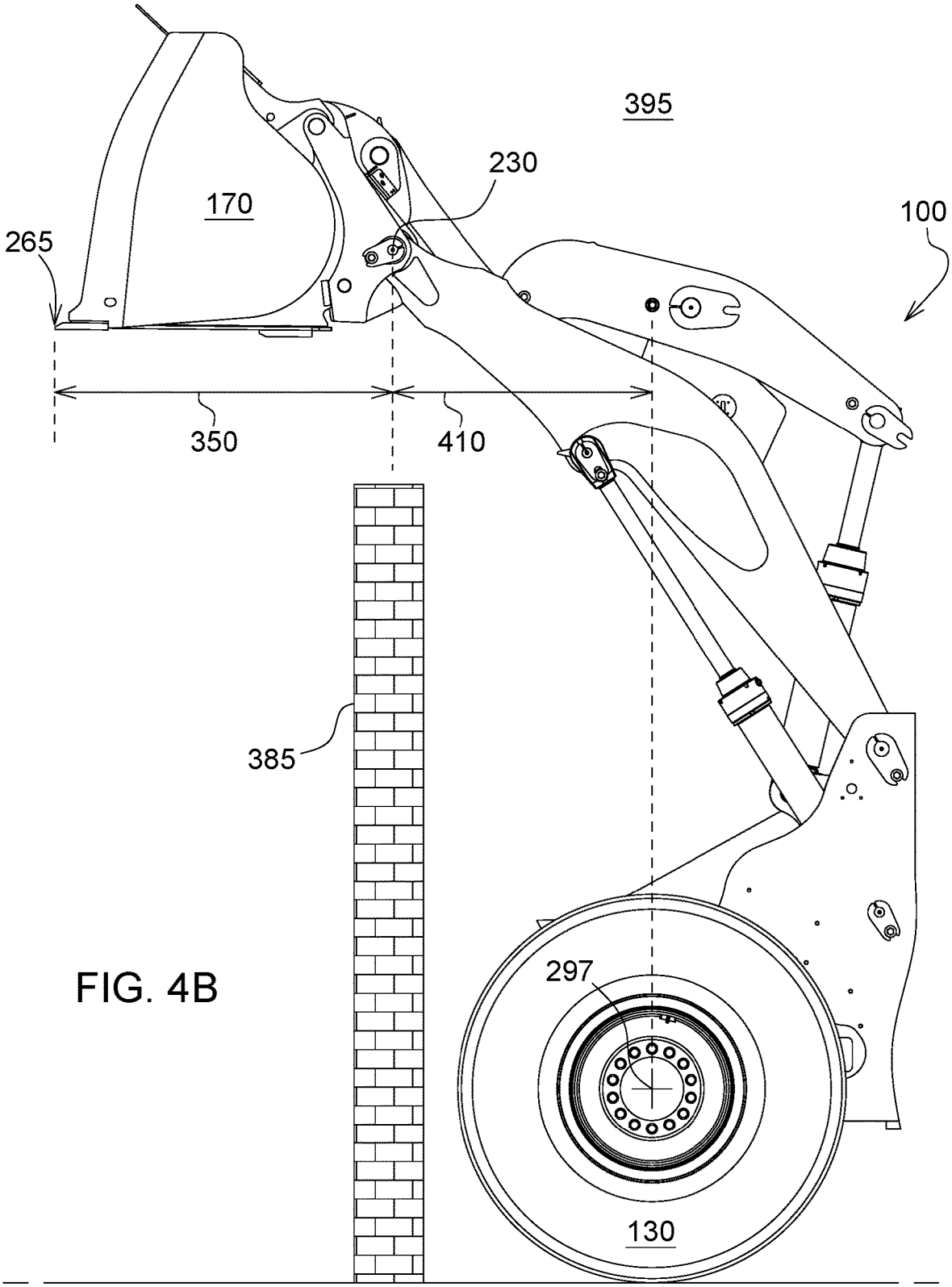
FIG. 4B illustrates an example view of a work machine performing a leveling operation in accordance with aspects of the present disclosure.
Figure 4C:
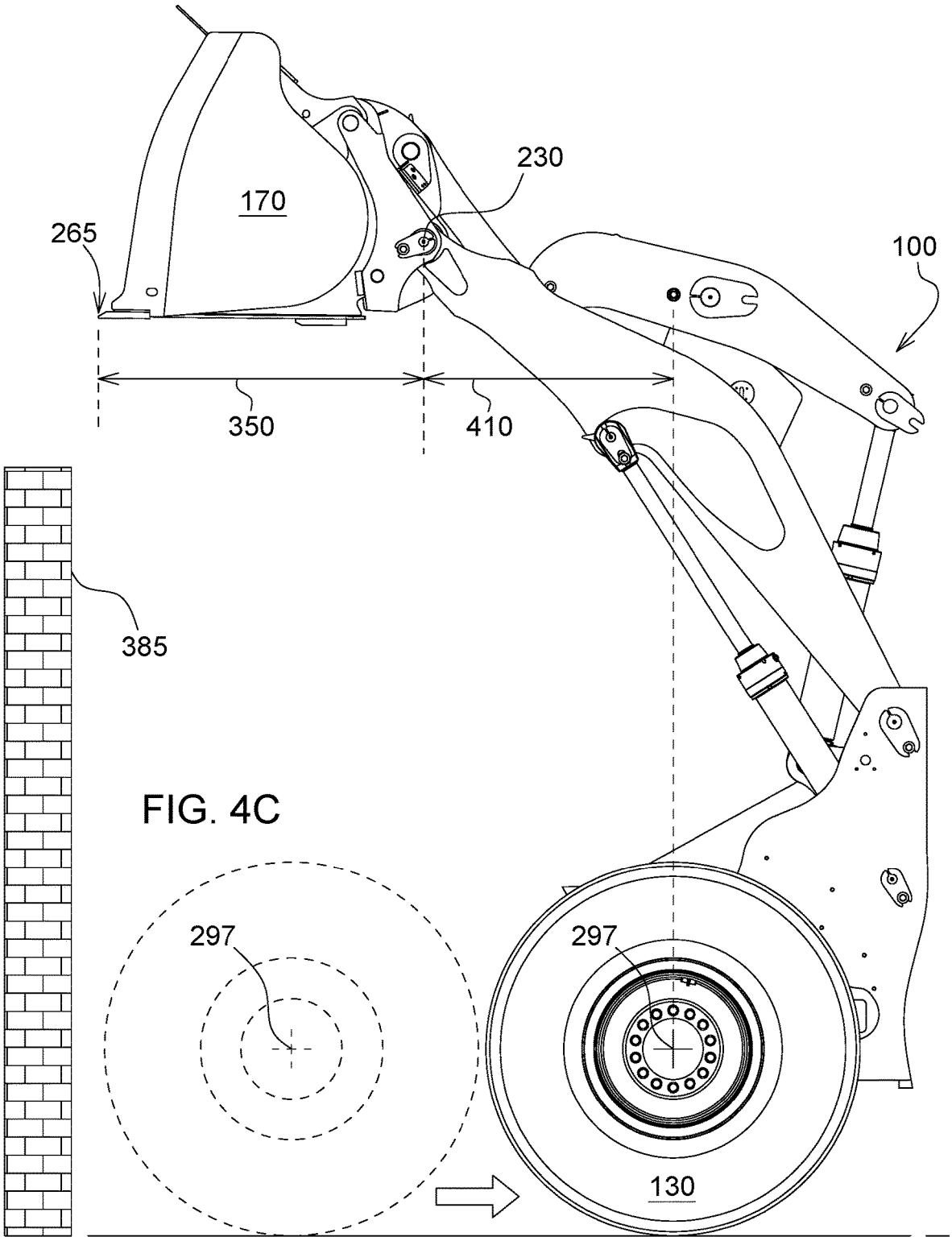
FIG. 4C illustrates an example view of a work machine demonstrating a predetermined threshold in accordance with aspects of the present disclosure.
Figure 4D:
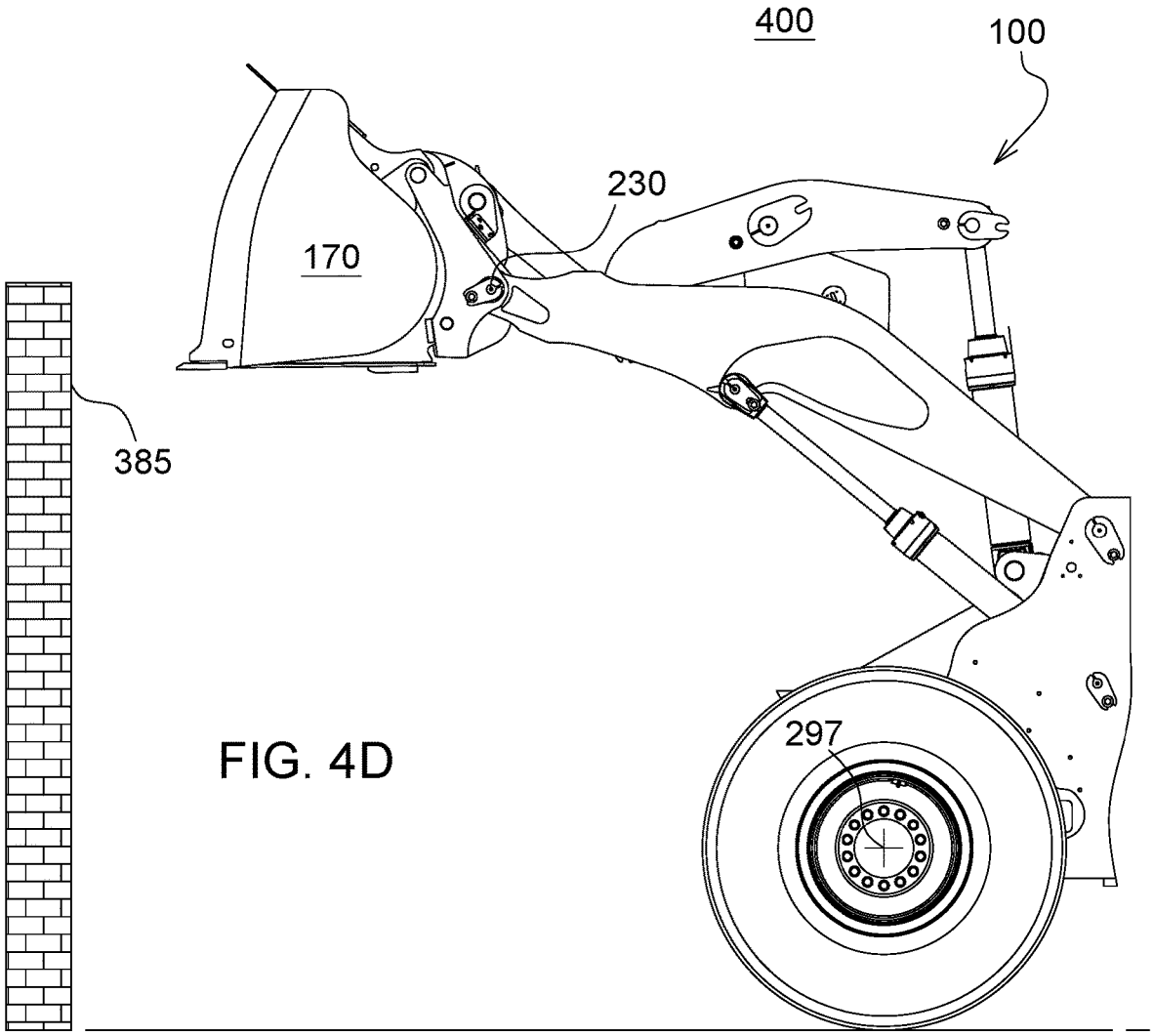
FIG. 4D illustrates an example view of a work machine with a lowering operation in accordance with aspects of the present disclosure.

Now turning to FIGS. 4A-4D with continued reference to FIG. 2, the machine control module 180 may further comprise an object clearance unit 370, wherein the object clearance unit 370 may be communicatively coupled to the boom actuator 215 and the attachment actuator 220. The object clearance unit 370 may be configured to activate and de-activate an object clearance mode 375 based on an object clearance signal 380 from the operator input device 160. Alternatively, the object clearance mode 375 may be automated as part of a dumping cycle pre-programmed on the machine control module 180. When dumping material into a bin 385, it is not uncommon for an operator to slightly misjudge the placement of the attachment 170 relative to the bin 385 of a dump truck. This slight misjudgment can result in unwanted contact between the attachment 170 and the bin 385. For example, if the work machine 100 were to move rearwardly with the attachment positioned as shown in FIG. 4A, the bottom surface 327 of the attachment would interfere with the bin 385. This erroneous positioning is further aggravated by use of aftermarket components where the machine control module 180 does not recognize the attachment 170, or the geometric parameters 240 of the attachment 170. The object clearance unit 370 in combination with the aforementioned units (i.e. the receiving unit 300, the calculation unit 305, the calibration unit 310 of the attachment calibration control system 250) addresses this issue. The object clearance mode 375 restricts the sequential movement of the attachment 170 after a dumping position 390 (shown in FIG. 4A) to a leveling position 395 (shown in FIG. 4B) and subsequently to a lowering position 400 (shown in FIG. 4D). The lowering position 400 (shown in FIG. 4D) is restricted until a rearward movement (designated by arrow in FIG. 4C) of the work machine 100 exceeds a predetermined threshold. The predetermined threshold may comprise a first horizontal position data 350 of the attachment pivot 230 relative to the attachment tip 265 (acquired during the steps of the attachment calibration control system 250), and a second horizontal position data 410 of the attachment pivot 230 relative to the ground engaging supports 130 which is a known value as this is based on the linkage geometry and kinematics of the boom 190. That is, the distance the work machine 100 moves rearwardly is based on a first horizontal positional data 350 from the attachment pivot 230 relative to the attachment tip 265 derived from the calculations of the geometric parameters 240 from one or more steps from the attachment calibration control system 250, and the second horizontal position data 410 of the attachment pivot 230 relative to the ground engaging supports 130 may be calculated from the known linkage geometry of the boom. In one exemplary embodiment, the second horizontal position data may be based on a fixed known distance from the boom pivot 225 to the ground engaging supports 130 (e.g. the axis of the wheel 297 or a front surface of wheel based on a known diameter) and the linkage geometry from the attachment pivot 230 to the ground engaging supports 130. Rearward movement of the work machine (as shown by the arrow in FIG. 4C) may be calculated from several different methods. In one instance, rearward movement of the work machine 100 may be measured from an IMU sensor. Alternatively, the distance may be measured based on the number of rotations a ground-engaging support 130 rotates and the ground-engaging support's diameter. The aforementioned approach advantageously allows the operator to be certain the attachment clears the bin of the dump truck 385 prior to lowering the attachment 170 to avoid any collision. It further eliminates operator error during dumping cycles when using aftermarket attachments and allows the operator to use pre-programmed software offered by the original manufacturer of the work machine 100.

Figure 5:
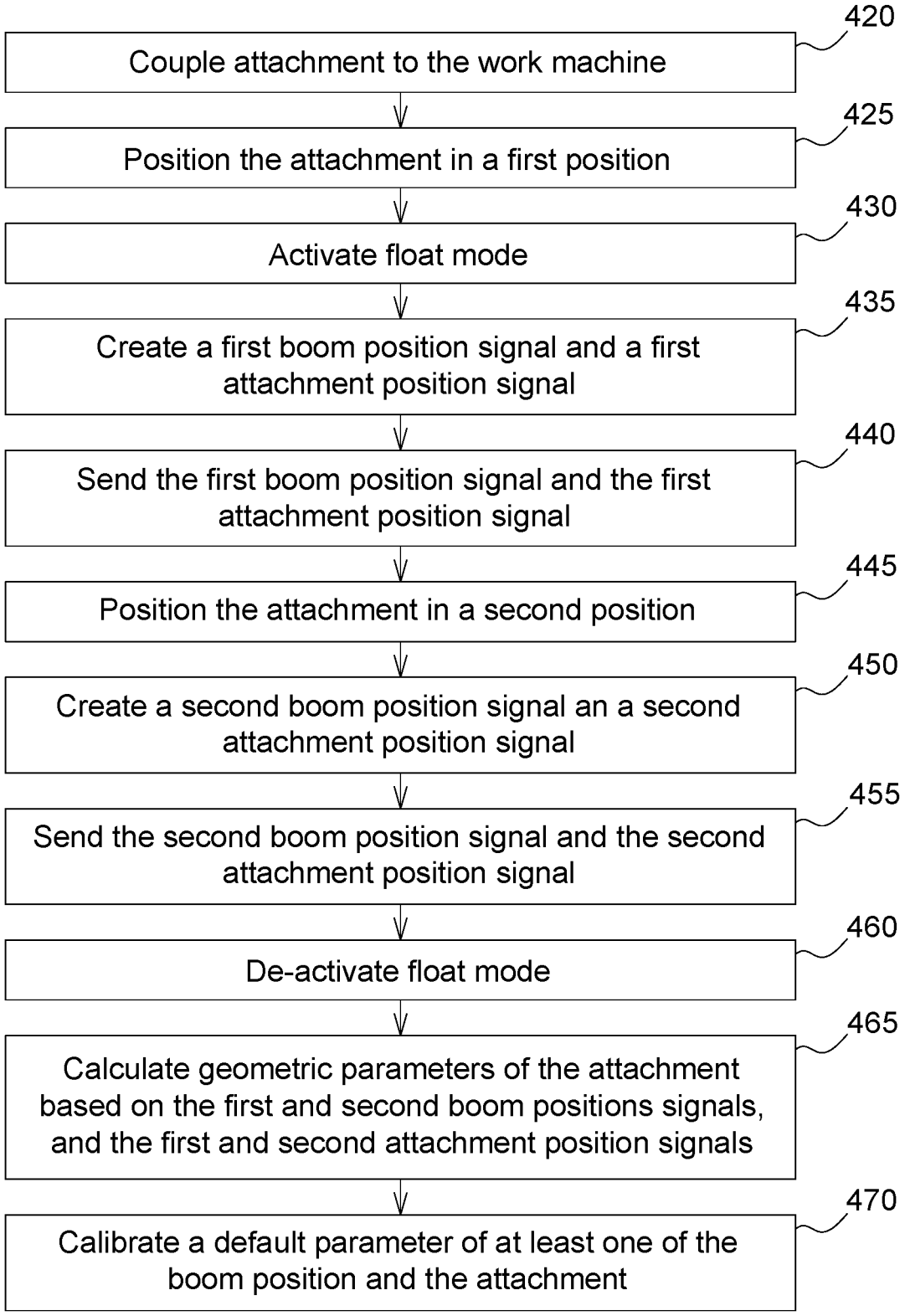
FIG. 5 is a flow chart of a method executed by the attachment calibration control system of FIG. 2.

Now referring to FIG. 5, with continued reference to FIGS. 1-4, a method of calibrating an attachment pivotally coupled to a work machine, is shown. In a first block 420 of the method, the attachment is coupled to the work machine such that the attachment is pivotally coupled about an attachment pivot to a second portion of the boom of the work machine.

In a next block 425, the operator positions the attachment in a first position using a user input device.

In a next block 430, the operator may activate float in the machine control module using a user input device.

In a next block 435, the boom position sensor creates a first boom position signal and the attachment position sensor creates first attachment position signal based on the first position.

In a next block 440, the boom position sensor and the attachment position sensor sends the first boom position signal and the first attachment position signal to the machine control module.

In a next block 445, the operator may de-activate the float mode in the machine control module using a user input device.

In a next block 450, the operator positions the attachment in a second position using a user input device.

In a next block 455, the boom position sensor creates a second boom position signal and the attachment position sensor creates a second attachment position signal based on the second position.

In a next block 460, the boom position sensor and the attachment position sensor sends the second boom position signal and the second attachment position signal to the machine control module.

In a next block 465, the machine control module calculates geometric parameters of the attachment based on the first and the second boom position signals, and the first and the second attachment position signals wherein the signals are received by the machine control module.

In a next block 470, the machine control module calibrates a default parameter of at least one of the boom position and the attachment position based on the geometric parameters of the attachment in the machine control module.

Once the operator calibrates the default parameters, the operator may activate object clearance mode during a dump cycle by initiating an object clearance signal from the operator input device to an object clearance unit wherein the object clearance mode restricts sequential movement of the attachment after a dumping position to a leveling position and subsequently to a lowering position.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims.

What is claimed is:

1. An attachment calibration control system for a work machine having a frame, ground engaging supports to support the frame on a geographic surface, an operator cab on the frame and having an operator input device, the system comprising:

a boom having a first portion and a second portion, the first portion coupled to the frame about a boom pivot;

an attachment pivotally coupled to the second portion of the boom about an attachment pivot, the attachment having a tip;

a boom actuator coupled to the boom, the boom actuator configured to controllably move the boom about the boom pivot in response to a boom control signal;

an attachment actuator coupled to the attachment, the attachment actuator configured to controllably move the attachment about the attachment pivot in response to an attachment control signal;

a boom position sensor coupled to the boom actuator, the boom position sensor configured to sense a boom position and send a boom position signal;

an attachment position sensor coupled to the attachment actuator, the attachment position sensor configured to sense an attachment position and send an attachment position signal; and a machine control module comprising a receiving unit configured to receive a plurality of boom position signals and a plurality of attachment position signals, the plurality of boom position signals and the plurality of attachment position signals correlating to a plurality of sequential attachment positions, a calculation unit configured to calculate geometric parameters of the attachment based on the plurality of attachment position signals and the plurality of boom position signals correlating to the plurality of sequential attachment positions, and a calibration unit communicatively coupled to the boom actuator and the attachment actuator, the calibration unit configured to adjust a default parameter of at least one of the boom position and the attachment position based on the geometric parameters of the attachment.

2. The system of claim 1, wherein the attachment is detachable from the boom.

3. The system of claim 1, wherein the machine control module further comprises a float unit, the float unit communicatively coupled to the boom actuator and the attachment actuator, the float unit configured to activate and de-activate a float mode based on a float signal from the operator input device.

4. The system of claim 3, wherein the float mode places a net zero downward pressure on the attachment contacting a level surface.

5. The system of claim 1, wherein the plurality of sequential attachment positions comprises the attachment pivoting about a point where the attachment tip engages a level surface.

6. The system of claim 5, wherein the level surface is at least one of the geographic surface and a man-made surface.

7. The system of claim 1, wherein the geometric parameters comprises of an angular position data of the attachment pivot relative to the attachment tip and a level surface, a vertical position data of the attachment pivot relative to the level surface, and a horizontal position data of the attachment pivot relative to the attachment tip.

8. The system of claim 7, wherein the machine control module further comprises an object clearance unit, the object clearance unit communicatively coupled to the boom actuator and the attachment actuator, the object clearance unit configured to activate and de-activate an object clearance mode based on an object clearance signal from the operator input device.

9. The system of claim 8, wherein the object clearance mode restricts a sequential movement of the attachment after a dumping position to a leveling position and subsequently to a lowering position.

10. The system of claim 9, wherein the lowering position is restricted until a rearward movement of the work machine exceeds a predetermined threshold, the predetermined threshold based on the horizontal position data of the attachment pivot relative to the attachment tip, the horizontal position data being a first horizontal position data, and a second horizontal position data of the attachment pivot relative to the ground engaging supports.

11. A method of calibrating an attachment pivotally coupled to a work machine, the work machine having a frame, a boom having a first portion and a second portion, the first portion of the boom coupled to the frame, ground engaging supports to support the frame on a geographic surface, an operator cab mounted on the frame and having an operator input device, the method comprising:

coupling the attachment to the work machine such that the attachment is pivotally coupled about an attachment pivot to the second portion of the boom of the work machine;

positioning the attachment in a first position;

creating a first boom position signal using a boom position sensor and a first attachment position signal using an attachment position sensor based on the first position;

sending the first boom position signal and the first attachment position signal to a machine control module located on the frame of the work machine;

positioning the attachment in a second position;

creating a second boom position signal using the boom position sensor and a second attachment position signal using the attachment position sensor based on the second position;

sending the second boom position signal and the second attachment position signal to the machine control module;

calculating geometric parameters of the attachment based on the first and second boom position signals, and the first and second attachment position signals wherein the boom position signals and the attachment position signals are received by the machine control module;

calibrating a default parameter of at least one of the boom position and the attachment position based on the geometric parameters of the attachment in the machine control module.

12. The method of claim 11, the method further comprising:

activating a float mode based on a float signal from the operator input device prior to positioning the attachment in the first position; and de-activating the float mode based on a de-float signal from the operator input device after calibrating the default parameter of at least one of the boom position and the attachment position.

13. The method of claim 11, wherein the float mode places a net zero downward pressure on the attachment contacting a level surface.

14. The method of claim 11, wherein the position the attachment from the first position to the second position pivots the attachment about a point where the attachment tip engages a level surface.

15. The method of claim 14, wherein the level surface is at least one of the geographic surface and a man-made surface.

16. The method of claim 11, wherein the geometric parameters comprises an angular position data of the attachment pivot relative to the attachment tip and a level surface, a vertical position data of the attachment pivot relative to the level surface, and a horizontal position data of the attachment pivot relative to the attachment tip.

17. The method of claim 16, the method further comprising:

activating an object clearance mode based on an object clearance signal from the operator input device to an object clearance unit, the object clearance mode restricting sequential movement of the attachment after a dumping position to a leveling position and subsequently to a lowering position.

18. The method of claim 17, wherein the object clearance unit is communicatively coupled to the boom actuator and the attachment actuator.

19. The method of claim 18, wherein the lowering position is restricted until a rearward movement of the work machine exceeds a predetermined threshold, the predetermined threshold based on the horizontal position data of the attachment pivot relative to the attachment tip, the horizontal position data being a first horizontal position data, and a second horizontal position data of the attachment pivot relative to the ground engaging support.

20. A work machine including an attachment calibration control system for an attachment, the work machine comprising:

a frame configured to house a power source, the frame supported by ground engaging supports to support the frame on a geographic surface;

an operator cab mounted on the frame, the operator cab having an operator input device;

a boom having a first portion and a second portion, the first portion pivotally coupled to the frame about a boom pivot;

an attachment pivotally coupled to the second portion of the boom about an attachment pivot, the attachment having a tip;

a boom actuator coupled to the boom, the boom actuator configured to controllably move the boom about the boom pivot in response to a boom control signal;

an attachment actuator coupled to the attachment, the attachment actuator configured to controllably move the attachment about the attachment pivot in response to an attachment control signal;

a boom position sensor coupled to the boom actuator, the boom position sensor configured to sense a boom position and send a boom position signal;

an attachment position sensor coupled to the attachment actuator, the attachment position sensor configured to sense an attachment position and send an attachment position signal; and a machine control module comprising a receiving unit configured to receive a plurality of boom position signals and a plurality of attachment position signals, the plurality of boom position signals and the plurality of attachment position signals correlating to a plurality of sequential attachment positions, the plurality of sequential attachment positions having the attachment tip pivot about a point where the attachment tip engages a geographic surface, a calculation unit configured to calculate geometric parameters of the attachment based on the plurality of attachment position signals and the plurality of boom position signals correlating to the plurality of sequential attachment positions, and a calibration unit communicatively coupled to the boom actuator and the attachment actuator, the calibration unit configured to adjust a default parameter of at least one of the boom position and the attachment position based on the geometric parameters of the attachment.

* * * * *